United States Patent [19]

Doak

[11] 3,945,536

[45] Mar. 23, 1976

[54] SANITIZING AND CLEANING DEVICE FOR PRESSURIZED SOFT DRINK SYSTEMS AND THE LIKE

[76] Inventor: Gerald Doak, 627 Garwood Ave., Winnipeg, Manitoba, Canada

[22] Filed: Nov. 11, 1974

[21] Appl. No.: 522,462

[30] Foreign Application Priority Data

Nov. 16, 1973 United Kingdom ..... 53297/73

[52] U.S. Cl. ..... 222/148; 137/238; 222/66

[51] Int. Cl.[2] ..... B67D 1/08

[58] Field of Search . 137/240, 241, 246.14, 246.13, 137/238; 222/66, 129.1, 148

[56] References Cited

UNITED STATES PATENTS

| | | | |
|---|---|---|---|
| 2,619,119 | 11/1952 | Warcup | 137/240 |
| 2,952,209 | 9/1960 | Scholin | 222/66 X |
| 3,389,716 | 6/1968 | Wilburn | 137/240 |

*Primary Examiner*—Allen N. Knowles
*Attorney, Agent, or Firm*—Stanley G. Ade

[57] ABSTRACT

A tank is provided which may be filled with water and pressurized from a $CO_2$ bottle or the like and it may be connected to the system to be cleansed by means of conventional quick connector hoses. An inner container is provided which holds a cleansing solution and a valve system is located within the inner container connecting and disconnecting same to the outlet of the main tank. When pressure is applied to the main tank, a one-way valve in the container permits this pressure to act upon the liquid within the container which is then forced into the valve system and thence to the outlet of the main tank mixing with water from the main tank as it passes from the outlet. The discharge of the liquid is controlled by the dispensing taps of the system to which it is attached. When the cleansing solution is exhausted from the inner container, the valve system closes and the remaining water in the main tank is then forced through the system to purge the lines of cleansing liquid and dissolved deposits. Once the tank and container are filled and connected to the soft drink system, operation is by opening and closing of the drink dispensing taps at the dispensing head.

14 Claims, 3 Drawing Figures

SANITIZING AND CLEANING DEVICE FOR PRESSURIZED SOFT DRINK SYSTEMS AND THE LIKE

BACKGROUND OF THE INVENTION

This invention relates to new and useful improvements in apparatus for the cleaning of soft drink dispensing equipment.

Such equipment normally consists of a source of $CO_2$ gas, tanks or pre or post mixed drinks of various flavors, a cooling or chilling unit and a series of dispensing taps whereby the requisite flavour of drink can be dispensed in the conventional manner.

Flexible lengths of hose with quick connect couplings on either end, couple the $CO_2$ tank to the premix tanks and it is quite conventional that a plurality of tanks of one flavour be coupled together in series by what are known as jumper hoses, once again using the conventional quick connect couplings.

All of this equipment has to be cleaned on a regular basis for obvious reasons and this cleansing process is normally time consuming and arduous.

Also to be cleaned are the lines or hoses running between the tanks and the cooling unit and the lines extending between the cooling unit and the dispensing head.

SUMMARY OF THE INVENTION

The present arrangement permits the sanitizing and cleansing of all of the equipment readily and easily so that the principal object and essence of the invention is to provide apparatus which can readily be hooked into circuit with the existing equipment whereby the existing equipment can be sanitized and cleansed readily and easily and on an automatic cycle.

Another object of the invention is to provide a device of the character herewithin described which is portable in concept so that it can easily be moved from one system to another.

Another object of the invention is to provide a device of the character herewithin described which includes means to sanitize and clean the jumper hoses when desired.

A still further object of the invention is to provide a device of the character herewithin described which may be hooked up to the existing $CO_2$ tank which supplies the necessary pressure to operate the cleansing equipment.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

BRIEF DESCRIPTION OF THE DRAWINGS

In the drawings like characters of reference indicate corresponding parts in the different figures.

DETAILED DESCRIPTION

Figure 2:
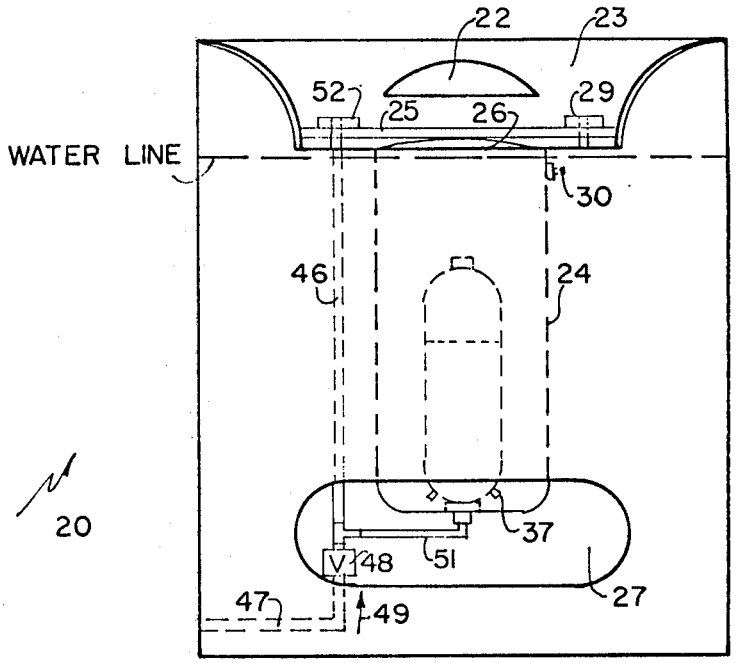
FIG. 2 is a partially isometric view of the device per se.
Figure 1:
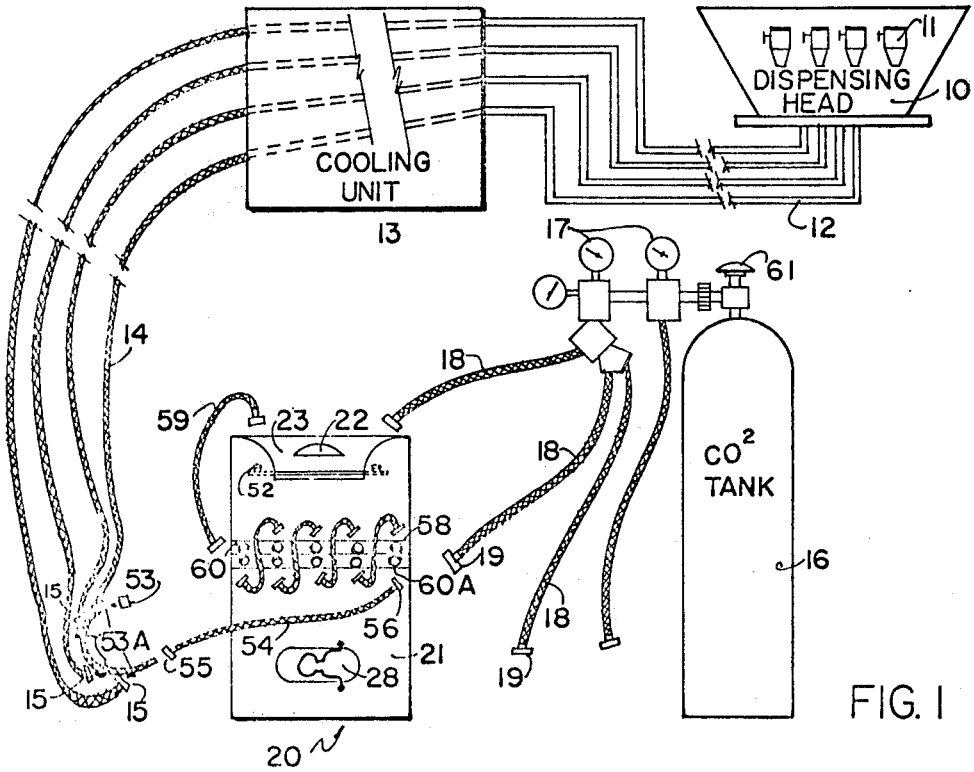
FIG. 1 is a partially schematic view showing the device in circuit with a drink dispensing system.

Proceeding therefore to describe the invention in detail, reference should first be made to FIG. 1 in which 10 illustrates schematically, a conventional drink dispensing head having a plurality of dispensing taps or handles 11 connected by lines or conduits 12 to a conventional cooling or chilling unit shown schematically by reference character 13.

Individual lines or conduits 14 extend from the unit 13 and may be connected to conventional tanks of pre or post mixed beverages (not illustrated) and these conduits are provided with conventional quick connect couplings 15 on the distal ends thereof for connection to the aforementioned drink tanks.

Carbonation and pressure to drive the beverage to the dispensing head is provided by a source of $CO_2$ as indicated by $CO_2$ tank 16 and control gauges 17 are connected to this tank together with a plurality of flexible hoses 18 each one of which may be connected to an individual drink tank by means of conventional quick connect couplings 19 on the distal ends of these hoses.

The device collectively designated 20 consists of a tank 21 having a convenient hand hold 22 provided in an upper shroud 23 which extends partially around the upper end of the tank.

Situated within this tank is a sanitizing fluid container 24 with the upper end coinciding with the upper side 25 of the main tank 21 and being provided with an access cover 26 detachably securable to the sanitizing fluid tank 24 in any conventional manner so that the cover can be in sealing relationship with the tank 24, when closed.

The remaining volume surrounding the container 24 is adapted to hold a supply of water which may be poured in through a further filler aperture 27 with the tank lying on its side. When full, a conventional cover 28 may be engaged with the aperture 27 in sealing relationship thus closing off the aperture. Alternatively, conventional valves may be provided in both container 24 and tank 21 for the filling of the necessary fluids therewithin.

A quick connect coupling 29 extends through the upper side 25 of the main tank 21 and communicates with the interior thereof and any one of the conduits 18 may be connected to this coupling thus supplying a source of $CO_2$ under pressure to the tank 21, and communicating with the volume within this tank surrounding the container 24.

Figure 3:
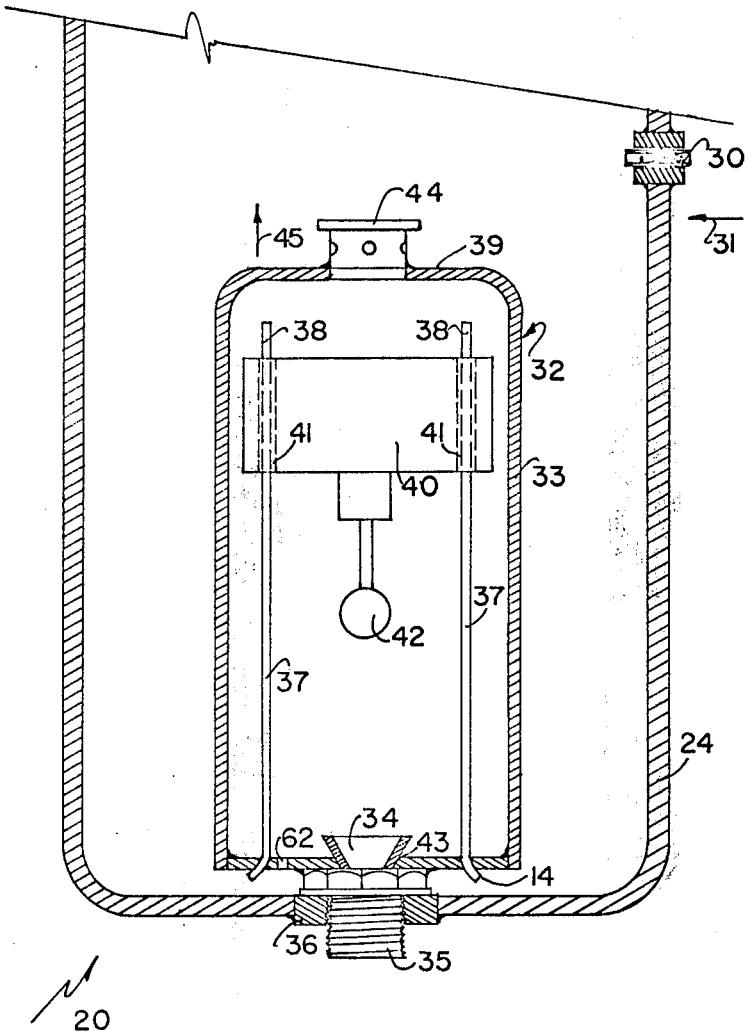
FIG. 3 is an enlarged fragmentary partially sectioned view of the sanitizing fluid container together with the automatic float device.

Situated through the wall of the container 24 is a one-way or back check valve 30 communicating with the interior of container 24 and the volume within tank 21 surrounding same and this one-way valve permits $CO_2$ under pressure within tank 21 to be fed into the container 24 in the direction of arrow 31 (see FIG. 3). An automatic valve assembly collectively designated 32 is situated within container 24. It consists of a small cylindrical container 33 having an outlet 34 at the base thereof communicating with a screw threaded gland 35 by which the valve is screw threadably engaged within a nut 36 provided at the base of the container 24 so that the valve is in sealing relationship with the base of the container as clearly shown in FIG. 3.

Situated within the container 33 is a pair of tubes 37 extending through the base of the container and into the container 24 as clearly shown in FIG. 3. These two tubes extend upwardly in spaced and parallel relationship and terminate in open ends 38 adjacent the upper end 39 of the valve container 33. A float 40 is situated within the valve container 33 and is guided in vertical movement by the two vertical cutouts 41 on the side of the float, engaging the tubes 37 which act as guides for the float. A valve 42 extends below float 40 and is connected thereto and when the float is in the lowermost position, this valve 42 engages valve seat 43 surrounding the interior of nut 35 thus closing off the connection through the gland nut 35.

A one-way valve 44 is situated in the upper end 39 of the valve container 33 and allows air to escape from the valve container, in the direction of arrow 45, as the container is filling with fluid from container 24, through the tubes 37 as will hereinafter be described.

A conduit 46 extends downwardly into the main container 21 and terminates adjacent the base of the container as indicated by reference character 47 and a one-way valve 48 is situated adjacent the lower end 47, said one-way valve operating in the direction of arrow 49. A junction 50 is provided within conduit 46 and a branch conduit 51 extends from this junction and is connected to the aforementioned gland nut 35 extending through the base of the container 24.

A conventional quick connector 52 is provided at the upper end of conduit 46 externally of the container and is connected to hoses 14 as will hereinafter be described.

In this connection reference should be made to FIG. 1 in which a manifold 53 is provided with a plurality of quick connector attachments 53A adapted to receive the quick connectors 15 upon the ends of conduits 14 thus connecting all of the conduits to this manifold. A hose or conduit 54 is provided with quick connectors 55 and 56 upon the ends thereof, one of which is adapted to be connected to one end of the manifold 53 and the other end is adapted to be connected to the quick connector 52 on conduit 46 if the device is to be used without the cleaning of jumper cables.

If, however, jumper cables 57 are to be cleaned also, then these are connected in series to a manifold 58 secured to the outside of the main container 21 whereupon a further hose or conduit 59 extends between one end of the manifold as at 60 and the quick connector 52 and the connector 56 of conduit 54 is connected to the opposite end of the manifold 58 as indicated by reference character 60A. This means that any fluid passing from the container 21, passes through the conduit 59, through all of the jumper cables 47 and thence through conduit 54 to the conduits 14 connected to manifold 53.

OPERATION OF THE DEVICE

In operation, the container 24 is filled with a sanitizing or cleansing fluid and the cover 26 is clamped into position. The outer container 21 is filled with water through the aperture 27 and the cover 28 is then clamped into position.

The sanitizing fluid will flow by gravity through tubes 37 into the float chamber or container 33 so that the float rises into the uppermost position, with air escaping through the one-way air valve 44.

The $CO_2$ tank is connected to the quick connector 29 by means of one of the conduits 18 and the valve 61 on the tank 16 is opened thus supplying $CO_2$ under pressure to the outer container 21 upon the surface of water therewithin, thus pressurizing the system.

With the device connected to the conduits 14 either directly or through the jumper cables 57, the dispensing head taps 11 are opened and the $CO_2$ pressure upon the water in the container 21, causes some of this water to pass through conduit 46 and in this connection it should be appreciated that one-way valve 48 acts as a restricter so that the volume of water flowing at this point, may be controlled by choosing a valve having the desired flow characteristics. At the same time the $CO_2$ pressure enters the inner container 24 through the one-way valve 30 and applies pressure above the sanitizing or cleansing fluid within this container. This drives the fluid up through the tubes 37 and into the float chamber 33. With the float in the uppermost position, the fluid is then driven out through the gland nut 35 into conduit 51 where it is mixed with the water at the T or junction 50 and passes through the conduit 46, through conduits 14, through the cooling unit 13, through the conduits 12 and flows from the dispensing heads 11. This flow is continued until all of the sanitizing fluid has been discharged from the inner tank or container 24 and from the float chamber 33. As this point approaches, the level of fluid within the float chamber lowers and the float moves downwardly until such time as the valve 42 engages the seat 43 which shuts off the float chamber so that all of the $CO_2$ pressure is now directed upon the surface of water within the outer container 21 flowing through the conduit end 47. This causes a change in pressure which is easily recognized by the operator at the dispensing head taps and if desired, the taps are closed at this point so that sanitizing fluid contained within all of the lines and apparatus may act to dissolve any deposits which may be present within the lines.

At this point it is essential that no residual sanitizing fluid is allowed to enter the system and this is ensured by the valve 42 remaining upon seat 31. In the event that there may be some residual sanitizing fluid within the valve chamber 33 which might lift the valve, a relatively small aperture 62 is provided within the base of the valve chamber so that any residual fluid may drain outwardly therefrom.

When the desired waiting period has expired, the taps 11 are once again opened so that $CO_2$ pressure acting upon the water within the outer container 21, drives this water through the entire system thus purging same of all sanitizing and cleansing fluid together with any deposits which may have been dissolved therein. This action continues until all of the water has been expelled from the container and $CO_2$ gas is passing through the entire system to purge same of all fluids and to dry the lines completely. When this has taken place, the taps are closed and the device is disconnected from the system which is then ready for use.

It will therefore be seen that once the device is filled with necessary fluids and connected in series with the system, the action of the device is automatic so that first a sanitizing or cleansing fluid is fed into the lines followed by fresh rinsing water and then followed by $CO_2$ of any other available gas under pressure.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. Apparatus detachably connected to soft drink dispensing systems and the like which include a source of gas under pressure, various drink dispensing conduits normally connected between tanks of post or pre mixed drinks and a dispensing head, said dispensing head including a control tap for each of said conduits for dispensing the drink under pressure provided by the source of gas, said conduits being detachably connected to said tanks by means of conventional quick connector couplings; the apparatus comprising in combination a main tank, means to fill said tank with a rinsing fluid such as water, means on said main tank connectable to the associated source of gas under pressure to pressurize the contents of said main tank, outlet means on said main tank detachably and operatively connectable to the drink conduits and dispensing head of the associated dispensing system, said last mentioned means including a conduit having the intake end thereof adjacent the base of said tank and extending downwardly into said tank, and a one-way valve adjacent said intake end acting in the direction of the other end of said last mentioned conduit, a cleansing fluid container within said main tank, means to fill said container with cleaning fluid, means communicating between said tank and said container whereby when said main tank is pressurized, said container is also pressurized, and an automatic valve assembly within said container controlling said discharge of the associated cleansing fluid in said container to said outlet means of said main tank, means operatively connecting said automatic valve assembly with said outlet means whereby when the associated dispensing head control tap is opened, gas under pressure forces the cleaning fluid from said container into said outlet means and thence through said system, said automatic valve assembly closing off said container from said tank when the contents of said container have been discharged.

2. The apparatus according to claim 1 in which said container is situated within said tank with the upper end of said container adjacent the upper end of said tank and above the fluid line of said tank, said means communicating between said container and said tank, comprising a one-way valve in said container above the fluid line of said tank, said one-way valve operating from the outside of said container into the interior thereof.

3. The apparatus according to claim 2 in which said automatic valve assembly includes a valve container within said first mentioned container, an outlet in the base of said valve container communicating through the wall of said first mentioned container and being operatively connected to said outlet means between the one-way valve thereof and said other end of said outlet conduit, a float valve assembly in said valve container closing off said outlet of said valve container when in the lowermost position and opening the outlet of said valve container when moved upwardly from said outlet of said valve container, fluid means communicating between said container and said valve container and air escape means adjacent the upper end of said valve container.

4. The apparatus according to claim 3 in which said fluid means connecting between said container and said valve container includes at least one substantially vertical conduit secured by one end thereof adjacent the base of said valve container and extending upwardly within said valve container to adjacent the upper end of said valve container, said float assembly including a float, float guide means on said float and a valve head connected to the underside of said float, said float guide means freely engaging over said last mentioned conduit, said last mentioned conduit acting as a guide for said float valve assembly.

5. The apparatus according to claim 4 in which said means operatively connecting said automatic float assembly with said outlet means includes a further conduit extending from the base of said automatic float assembly to the conduit of said outlet means between said one-way valve of said outlet means and said other end of said outlet means, said last mentioned one-way valve acting as a restrictor for the passage of fluid from said main tank to said outlet means whereby the contents of said container are discharged prior to the contents of said tank, said restrictor permitting a portion of the contents of said tank to mix with the contents of said container as said contents are being discharged through said outlet means.

6. The apparatus according to claim 3 in which said means operatively connecting said automatic float assembly with said outlet means includes a further conduit extending from the base of said automatic float assembly to the conduit of said outlet means between said one-way valve of said outlet means and said other end of said outlet means, said last mentioned one-way valve acting as a restrictor for the passage of fluid from said main tank to said outlet means whereby the contents of said container are discharged prior to the contents of said tank, said restrictor permitting a portion of the contents of said tank to mix with the contents of said container as said contents are being discharged through said outlet means.

7. The apparatus according to claim 2 in which said means operatively connecting said automatic float assembly with said outlet means includes a further conduit extending from the base of said automatic float assembly to the conduit of said outlet means between said one-way valve of said outlet means and said other end of said outlet means, said last mentioned one-way valve acting as a restrictor for the passage of fluid from said main tank to said outlet means whereby the contents of said container are discharged prior to the contents of said tank, said restrictor permitting a portion of the contents of said tank to mix with the contents of said container as said contents are being discharged through said outlet means.

8. The apparatus according to claim 1 in which said automatic valve assembly includes a valve container within said first mentioned container, an outlet in the base of said valve container communicating through the wall of said first mentioned container and being operatively connected to said outlet means between the one-way valve thereof and said other end of said outlet conduit, a float valve assembly in said valve container closing off said outlet of said valve container when in the lowermost position and opening the outlet of said valve container when moved upwardly from said outlet of said valve container, fluid means communicating between said container and said valve container and air escape means adjacent the upper end of said valve container.

9. The apparatus according to claim 8 in which said fluid means connecting between said container and said valve container includes at least one substantially vertical conduit secured by one end thereof adjacent the base of said valve container and extending upwardly within said valve container to adjacent the upper end of said valve container, said float assembly including a float, float guide means on said float and a valve head connected to the underside of said float, said float guide means freely engaging over said last mentioned conduit, said last mentioned conduit acting as a guide for said float valve assembly.

10. The apparatus according to claim 9 in which said means operatively connecting said automatic float assembly with said outlet means includes a further conduit extending from the base of said automatic float assembly to the conduit of said outlet means between said one-way valve of said outlet means and said other end of said outlet means, said last mentioned one-way valve acting as a restrictor for the passage of fluid from said main tank to said outlet means whereby the contents of said container are discharged prior to the contents of said tank, said restrictor permitting a portion of said contents of said tank to mix with the contents of said container as said contents are being discharged through said outlet means.

11. The apparatus according to claim 8 in which said means operatively connecting said automatic float assembly with said outlet means includes a further conduit extending from the base of said automatic float assembly to the conduit of said outlet means between said one-way valve of said outlet means and said other end of said outlet means, said last mentioned one-way valve acting as a restrictor for the passage of fluid from said main tank to said outlet means whereby the contents of said container are discharged prior to the contents of said tank, said restrictor permitting a portion of the contents of said tank to mix with the contents of said container as said contents are being discharged through said outlet means.

12. The apparatus according to claim 1 in which said means operatively connecting said automatic float assembly with said outlet means includes a further conduit extending from the base of said automatic float assembly to the conduit of said outlet means between said one-way valve of said outlet means and said other end of said outlet means, said last mentioned one-way valve acting as a restrictor for the passage of fluid from said main tank to said outlet means whereby the contents of said container are discharged prior to the contents of said tank, said restrictor permitting a portion of the contents of said tank to mix with the contents of said container as said contents are being discharged through said outlet means.

13. The apparatus according to claim 1 which includes a manifold connectable between said outlet means and the associated various drink conduits whereby a plurality of said last mentioned conduits may be operatively connected to said apparatus for individual cleansing of said various conduits.

14. The apparatus according to claim 13 which includes a further manifold operatively connected between said outlet means and said first mentioned manifold, means on said further manifold for detachably connecting a plurality of associated jumper conduits in series whereby the contents of said tank and said container pass through said jumper conduits prior to entering said first mentioned manifold.

* * * * *